United States Patent [19]

Caouette

[11] Patent Number: 4,909,665

[45] Date of Patent: Mar. 20, 1990

[54] FABRIC-COVERED STRUCTURE

[76] Inventor: Henry H. Caouette, Riverside Dr., Mechanic Falls, Me. 04256

[21] Appl. No.: 232,701

[22] Filed: Aug. 16, 1988

[51] Int. Cl.[4] ..... E02B 13/00

[52] U.S. Cl. ..... 405/45; 405/36; 405/43; 210/459

[58] Field of Search ..... 405/43–49, 405/36, 38, 39; 210/459, 247, 485

[56] References Cited

U.S. PATENT DOCUMENTS

| | | | |
|---|---|---|---|
| 1,753,900 | 4/1930 | Naef | 210/459 X |
| 2,068,511 | 1/1937 | Raisch | 210/459 X |
| 3,240,347 | 3/1966 | Zieyers et al. | 210/459 |
| 3,302,408 | 2/1967 | Schmid | 405/44 |
| 3,830,373 | 8/1974 | Sixt et al. | 405/49 X |
| 3,976,578 | 8/1976 | Beane | 405/49 X |
| 4,288,321 | 9/1981 | Beane | 405/45 X |

FOREIGN PATENT DOCUMENTS

| | | | |
|---|---|---|---|
| 2332545 | 1/1974 | Fed. Rep. of Germany | 405/45 |
| 2555036 | 6/1976 | Fed. Rep. of Germany | 405/43 |

*Primary Examiner*—Dennis L. Taylor
*Attorney, Agent, or Firm*—William Nitkin

[57] ABSTRACT

A fabric wrapped corrugated structure of the type having a series of adjacent peaks and valleys with a separation structure disposed between the fabric wrapping and the peaks of the corrugated structure to allow fluid passage from the valleys through the fabric wrapping in areas above both the peaks and valleys of the corrugated structure.

6 Claims, 1 Drawing Sheet

FABRIC-COVERED STRUCTURE

BACKGROUND OF THE INVENTION

1. Field of the Invention

The structure of this invention resides in the art of fabric-covered corrugated drainage structures and more particularly relates to corrugated pipes and other corrugated products which are covered with a fabric material with a separation grid structure provided between the peak portions of the corrugations and the fabric covering to promote fluid flow from inside the covered structure to all areas of its fabric covering.

2. Description of the Prior Art

Corregated pipes have wide use in disposal and irrigation systems. In disposal systems perforated corrugated pipes are used and are commonly made of a thermoplastic material such as ABS, styrene polymers, polyethelene or equivalent some of which materials have carbon mixed therewith. In septic systems a house sewer line extends to a septic tank which provides for the separation therein of sewerage into three layers: a solid sludge which settles therein, an upper floating scum layer, and a middle layer of effluent which is carried out of the septic tank through an outlet pipe to a drainage field system. In the drainage field the effluent is carried through a series of perforated pipes which are buried within drainage trenches in the ground. The effluent passes through the perforations in the pipes and seeps into the earth where impurities in such fluid are neutralized. Pipes used in such drainage field systems are frequently of corrugated construction since such pipe construction provides great strength allowing for a thinner pipe wall than would be required for a non-corrugated perforated pipe to support the load that occurs on the ground thereabove. Over time the pipe's perforations can become plugged, and it is expected that at some time within a twenty year period a typical drainage field will have to be dug up and its pipes replaced due to blockage of the perforations in the perforated pipes. In some situations a biological mat forms at the interface of the liquid and the soil.

To keep dirt and gravel out of the valleys of the corrugations of the corrugated pipe and to assist in the formation of the biological mat, many corrugated pipes are wrapped with a woven or non-woven synthetic porous fabric material. Such material can be a porous netting where the pores are sufficiently fine so as to prevent soil and/or gravel from entering the valley areas of the corrugated pipe but yet large enough for fluid to pass therethrough. Such wrapped corrugated pipes are well known in the industry such as those manufactured by Hancor, Inc. of Findlay, Ohio. As the effluent passes through the perforations in the corrugated pipe and then through the fabric material, the biological mat forms on the fabric material which mat helps to react with, and neutralize, the effluent.

A cross-section along the axis of a typical piece of corrugated pipe shows spaced apart walls that extend from adjacent peaks down to a valley portion therebetween. In one embodiment, the walls generally converge symmetrically from adjacent peaks to the valley therebetween at about a 3 degree angle. Each peak can have a top portion with a generally undulating cross-section between adjacent valley sidewall portions. The peak's top portion has a first generally rounded, outwardly extending rib section adjacent to each sidewall which sidewalls extend down forming each valley and between each of these rib sections formed on each side of each peak is an inwardly extending rounded recess. The ribs and recess formed across the top of the peak help provide increased strength to the corrugated structure. The valley portions which are at the base of each of the sidewalls between adjacent peak areas are generally flat or slightly rounded in cross-section and have a series of perforations therein for fluid passage. The corrugations can have a sidewall height equivalent to the distance between the outer surfaces of top ribs facing each other on adjacent peaks, and the opening at the top of each valley can generally be of the same width as the width of the top portion of each peak. It should be noted that other cross-sectional formulas for the construction of the corrugated pipe can be utilized with such formulas relating the valley depth to the distance between corrugated peaks. It should be noted that a pipe structure with valleys and wide peaks, each peak with a recess therein, has substantially more strength than a pipe constructed of the same thickness of material but which is cylindrical with flat walls in cross-section. It is the desirable features of corrugated pipes, namely their light weight, cost-effectiveness and ease of handling and transportation that have made them desirable for use in drainage field systems and irrigation systems.

As mentioned above, in many instances the corrugated pipes are covered with a porous woven or non-woven synthetic fabric material to help keep soil and gravel out of the valleys of the corrugations and further to help form the biological mat for the breakdown of the waste products in the effluent from a septic tank. The perforations that are located in the bottoms of the valleys of corrugated pipe allow the fluid to pass out of the pipe to the area formed by the bottom of the valley and the side walls of the corrugation up to the sides of the peaks of the corrugations where the fluid contacts the fabric material and then passes therethrough. The fluid can only pass through the areas of the fabric where the fluid has direct contact with the fabric which is only in the area specifically above the valleys. Since no fluid passes beyond the rib areas on each side of a valley, no fluid passes through the porous fabric material that is placed over the width of the peaks of the corrugations. Thus the effluent can pass out of only approximately 50% of the exterior wrapped surface of the pipe using a one-to-one valley top width to peak width ratio. The fluid passing from the valley areas exits only through the fabric directly above the valleys which form the only areas that a biological mat can be created with no biological mat being formed in the areas of the fabric extending over the peaks which area is approximately, in the example used, 50% of the wrapped corrugated pipe's exterior surface. Therefore a problem that arises in the prior art is that usually only 50% of the exterior surface of the wrapped corrugated pipe is available for fluid drainage and for the formation of the biological mat thereupon.

SUMMARY OF THE INVENTION

It is an object of this invention to provide an improved fabric layer around a corrugated pipe or other corrugated structure to cause close to 100% of the area of the fabric to allow fluid passage therethrough and to allow formation of a biological mat over almost the entire fabric area for more efficient dispersal of effluent from a septic tank or increased passage of fluids for other purposes.

It is a further object of this invention to provide an improved corrugated pipe with a separation element disposed between the fabric covering of the corrugated pipe and the peaks of the corrugations which causes fluid passage through the fabric above the peak areas and for a biological mat to be formed in appropriate structures not only above each valley but also above each peak of the structure thereby allowing a biological mat to be formed over almost the entire structure.

It is yet still a further object of this invention to increase the effective surface area of a wrapped corrugated pipe on which a biological mat can be formed so that a smaller corrugated pipe can be used that will provide the same drainage capabilities of larger prior art wrapped corrugated pipes but which smaller pipe will effect an economy in cost, shipping as well as the size configuration of drainage field systems. For example, in a drainage field that might call for a 10-inch diameter corrugated pipe, an 8-inch diameter pipe of this invention could be utilized in its place because of the increased surface area through which the effluent can flow and form its biological mat.

It is to these ends that this invention provides an outer fabric combined with a grid mesh separation element such as, in one embodiment, a plastic mesh designed to separate the fabric from the peak portions of the corrugated pipe but yet have channels and apertures within the mesh to allow the effluent to pass not only through the fabric above the valleys but also through the fabric above the peak portions of the corrugated pipe.

DESCRIPTION OF THE PREFERRED EMBODIMENT(S)

Figure 1:
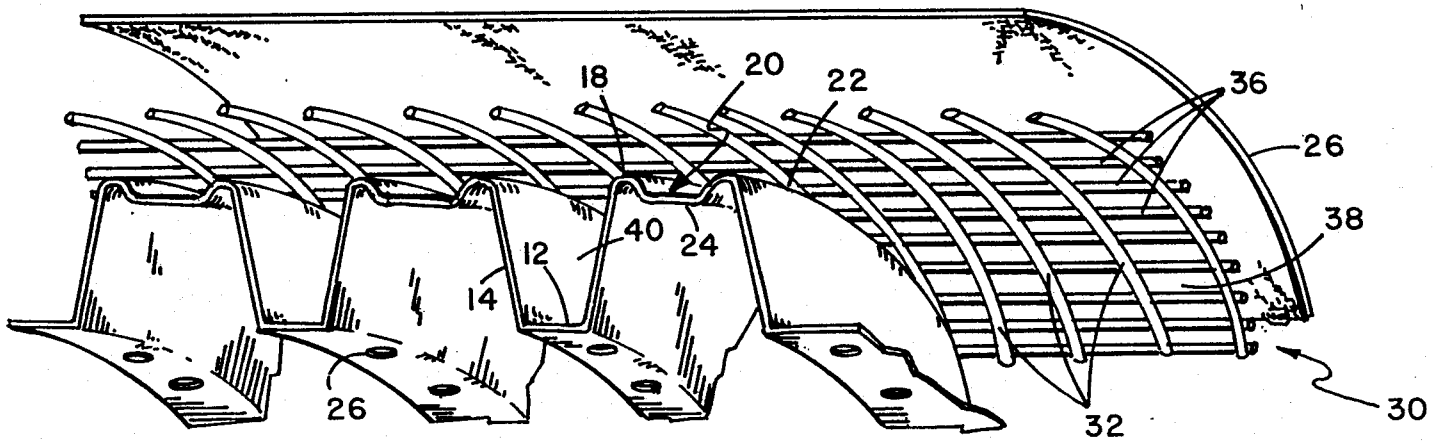
FIG. 1 illustrates a perspective cutaway view of the structure of this invention showing the corrugated pipe, the separation element and the fabric covering.

FIG. 1 shows a perspective cutaway cross-sectional view of corrugated pipe 10 having valleys 12 each with a first side wall 14 and second side wall 16 with first side wall 14 extending up to first rib 18 and second side wall 16 extending up to second rib 22 on peak 20. A rounded access 24 is formed between first rib 18 and second rib 22. Fabric 26 of the woven or non-woven type such as used in the prior art forming a fluid permeable porous material is wrapped around the pipe. Between fabric 26 and corrugated pipe 10 is disposed an intermediate layer of grid mesh 30 having an open grid work. When such mesh 30 is disposed above peaks 20, it has open channels to receive fluid therethrough from the perforations in the pipe such as perforations 25 and 28 formed in the bases of the valleys. The open grid work of mesh 30 has elements in one embodiment forming first cross members 32 and second cross members 36, each set of such cross members spaced apart from one another and overlapping with such first and second cross members disposed at angles to one another providing a series of channels 38 between adjacent first cross members 32. Fluid emanating from within corrugated pipe 10 passes through the perforations such as perforations 25 and 28 filling valley areas 40, and then passes through fabric 26 above each valley area, and also passes through channels 38 in grid mesh 30 between first cross members 32, and then passes through the spaces between second cross members 36, and then passes out fabric 26 above each peak, thereby effectively increasing the surface area for fluid dispersal and for the formation of a biological mat on a corrugated structure such as a pipe covered with the structure of this invention. It should be noted that corrugated pipes with the improved grid mesh/fabric covering of this invention can be utilized not only for drainage field systems but also for irrigation systems and other uses for improved dispersal of fluid.

It should be noted that in some configurations corrugated pipes could be constructed with a narrower peak which design would also increase the amount of fluid flowing through the fabric/mesh above the valleys. Currently, though, the corrugated pipes in use for drainage systems have wide peak widths corresponding in distance to valley top widths making the use of the intermediate grid mesh between the pipe and the fabric covering highly desirable.

One grid mesh which has been utilized successfully is Tenax Drainage Grids produced by the ATP Corporation, 7435 Selter Road, Ashtabula, Ohio. This material has a rectangular gridwork formed by elongated plastic members comprising a first series of narrow members extending spaced apart from one another in parallel fashion and a second series of narrow members spaced apart from one another in similar parallel fashion but extending at approximately right angles to the first series and adhered to the first series at their points of contact to form a grid work with a series of channels formed between the first series of members which are in contact with the peaks of the corrugated pipe so that the first series of members allow for fluid to pass from the pipe's valleys to the channel areas between adjacent members such as 32 and 36, as seen in FIG. 1, to areas above the peaks. The second series of members when attached above the first series of members form a plurality of apertures therewith, each aperture having the dimension of approximately $\frac{1}{4}$ inch$\times\frac{1}{4}$ inch. The resulting grid work allows the fluid flow passing substantially between the channels between the first series of members to then pass between the apertures formed by the second series of members of the grid mesh to the fabric adhered thereabove. Heat bonding or equivalent including adhesives can be used for adhering the fabric to the grid mesh, but it should be noted that it is not necessary for there to be a bonding between the fabric and the grid. The fabric and grid can merely be positioned substantially adjacent to one another.

It should be further noted that grid mesh 30 can take many different forms as long as one set of cross members or other members such as dimples on a planar structure having apertures or fibrous material provides some separation of the fabric above the peaks of the corrugated pipe and the grid mesh further provides channels and upper openings therein to allow the water or effluent to pass therethrough to the areas above the peaks and finally through fabric 26 thereabove.

Figure 2:
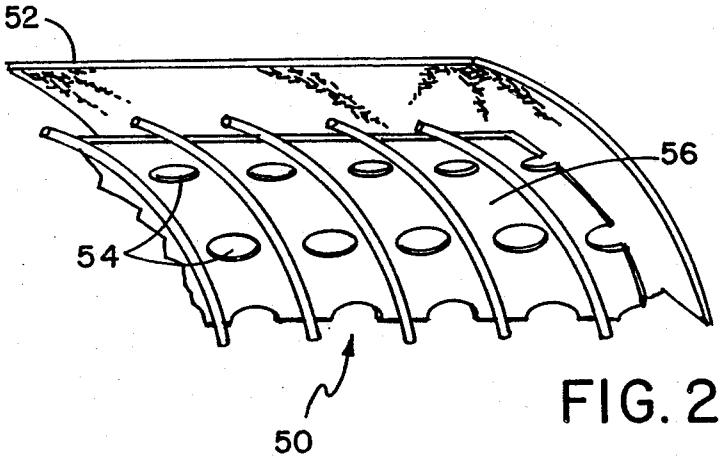
FIG. 2 illustrates an alternate embodiment of the separation element of this invention.

An example of another mesh/fabric design is illustrated in FIG. 2 which shows grid mesh 50 and fabric 52 with apertures 54 formed in grid mesh 50. A plurality of channel areas 56 allow the flow of water therethrough to apertures 54 disposed above the peak areas of the corrugated pipe.

In some embodiments the grid mesh material of this invention can be bonded to the fabric, and then this combined layered structure can be attached in contact over the peaks of the corrugated pipe and adhered by adhesive bonded with one end of the grid mesh/fabric wrapped around the pipe and bonded over a portion of itself and/or bonded to the corrugated structure inself, by staples or by equivalent means of attachment.

As mentioned above, other grid mesh designs can be used to provide a structure that allows the positioning of the fabric a distance above the peaks of the corrugated pipe so that fluid will flow through the mesh from the valley areas to above the peak areas which fluid then can pass through all areas of the fabric covering thereby increasing the surface area through which fluid or effluent can pass. Examples of such structures include Enkadrain material made by BASF Corporation which material is an interlocked open-fiber mesh and Miradrain 6000 made by Mirafi Inc. which material is a dimpled material with a non-woven fabric adhered to the tops of the dimples. In practice such material as Miradrain 6000 can be used as a separation material even though it has no perforations if it is wrapped almost all around the corrugated structure and a slot is left between the ends for fluid to pass through to get to the side of the dimpled material adjacent to the fabric for the fluid to then be able to pass through the fabric.

The grid mesh/fabric structure of this invention can also be used over other corrugated structures such as conduit which is used in drainage systems to effect the same fluid flow above the peak portions of such corrugated structure.

Although the present invention has been described with reference to particular embodiments, it will be apparent to those skilled in the art that variations and modifications can be substituted therefor without departing from the principles and spirit of the invention.

I claim:

1. In combination a fabric/grid mesh covering for a corrugated structure having peaks and valleys on its exterior surface with a plurality of perforations defined in said valleys for fluid passage, said fabric/grid mesh covering including a porous fabric substantially adjacent to a grid mesh separation structure formed of material with channels defined therein for positioning against said peaks and extending over the tops of said valleys and apertures defined in said grid mesh adjacent to and communicating with said channels adapted to allow fluid passing from said perforations in said valleys to pass through said channels and grid mesh apertures to said fabric disposed above said peaks and valleys of said corrugated structure.

2. An improved fabric-wrapped corrugated structure of the type having a series of adjacent peaks and valleys arrayed on the exterior of said structure,such valleys having a plurality of perforations defined therein for fluid passage, wherein the improvement comprises means to separate said fabric wrap from direct contact with said peaks and valleys of said corrugated structure wherein said separation means provide for the flow of fluid from said perforations to areas above said peaks and valleys and through said fabric wrap, said separation means comprising a grid mesh extending over the tops of said peaks and valleys, said grid mesh having channels defined therein over said peaks and valleys and said grid mesh having apertures adjacent to said fabric, said apertures being in communication with said channels to allow said fluid flow therethrough from said valleys to said fabric above said peaks.

3. The covering of claim 1 wherein said grid mesh comprises:

a plurality of substantially parallel spaced-apart first cross members;

a plurality of substantially parallel spaced-apart second cross members disposed at an angle to said first cross members, said second cross members positioned against and adhering to said first cross members at their overlapping points of contact, said members forming a gridwork with rectangular openings defined therein, said first series of cross members being disposed over said peaks and valleys, said first series of cross members forming a series of channels over said peaks and valleys, said rectangular openings formed by said first and second cross members forming said apertures in said grid mesh.

4. The covering of claim 3 wherein said grid mesh apertures measure approximately $\frac{1}{4}$ inch$\times\frac{1}{4}$ inch.

5. The corrugated structure of claim 2 wherein said grid mesh comprises:

a plurality of substantially parallel spaced-apart first cross members; and a plurality of substantially parallel spaced-apart second cross members disposed at an angle to said first cross members, said second cross members positioned against and adhering to said first cross members at their overlapping points of contact, said members forming a gridwork with rectangular openings defined therein, said first series of cross members being disposed over said peaks and valleys, said first series of cross members forming a series of channels over said peaks and valleys, said rectangular openings formed by said first and second cross members forming said apertures in said grid mesh.

6. The covering of claim 5 wherein said grid mesh apertures measure approximately $\frac{1}{4}$ inch$\times\frac{1}{4}$ inch.

* * * * *